United States Patent [19]

Hecht

[11] Patent Number: 4,967,586

[45] Date of Patent: Nov. 6, 1990

[54] UPSETTING PRESS FOR UPSETTING OR SWAGING WIRE SEGMENTS OF PREDETERMINED LENGTHS INTO BALLS OR THE LIKE

[75] Inventor: Jürgen Hecht, Wuppertal, Fed. Rep. of Germany

[73] Assignee: Gebr. Hilgeland GmbH and Co., Wuppertal, Fed. Rep. of Germany

[21] Appl. No.: 384,718

[22] Filed: Jul. 24, 1989

[51] Int. Cl.[5] ..... B21J 9/18

[52] U.S. Cl. ..... 72/451; 72/450; 72/452; 72/352; 100/281; 100/282; 100/292

[58] Field of Search ..... 100/280, 281, 282, 283, 100/284, 285, 272, 292; 72/450, 451, 452, 352, 360

[56] References Cited

U.S. PATENT DOCUMENTS

| | | | |
|---|---|---|---|
| 2,562,044 | 7/1951 | Klocke | 100/283 |
| 3,280,616 | 10/1966 | Szakacsi | 72/452 |
| 3,456,480 | 7/1969 | Baldyga | 72/451 |
| 3,585,837 | 6/1971 | Bihler | 72/452 |
| 3,785,282 | 1/1974 | Kamelander | 72/451 |
| 3,859,838 | 1/1975 | Karsnak | 100/281 |
| 4,189,933 | 2/1980 | Holloway | 72/452 |
| 4,306,443 | 12/1981 | Matsutani | 72/452 |

FOREIGN PATENT DOCUMENTS

| | | | |
|---|---|---|---|
| 1433112 | 4/1976 | United Kingdom | 100/282 |

*Primary Examiner*—David Jones

*Attorney, Agent, or Firm*—Robert W. Becker and Associates

[57] ABSTRACT

An upsetting press for swaging wire segments into balls or the like. The press includes a fixed matrix, a stamp holder provided for a stamp and mounted on a machine frame so as to be displaceable in the stamping direction, a cam drive mechanism for the stamp holder, and a gripper device provided for the wire segments. The cam drive mechanism is a double cam that is rotatably mounted in the machine frame. An angle lever is pivotably mounted in the machine frame. Follower rollers are carried by the angle lever and run on the double cam. A presser carriage is provided for the stamp holder and is guided in the machine frame in such a way that it can move back and forth. A knee lever is provided that has two arms, one of which is connected to the machine frame and the other of which is connected to the presser carriage. A connecting rod operatively interconnects the angle lever with the knee lever.

8 Claims, 2 Drawing Sheets

UPSETTING PRESS FOR UPSETTING OR SWAGING WIRE SEGMENTS OF PREDETERMINED LENGTHS INTO BALLS OR THE LIKE

BACKGROUND OF THE INVENTION

The present invention relates to an upsetting press for upsetting or swaging wire segments of predetermined lengths into balls or the like, with the press including a fixed matrix, a stamp holder that is provided for the movable die or stamp and is mounted on a machine frame in such a way as to be displaceable, a cam drive mechanism for the stamp holder, and gripper means that is provided for the wire segments and is controlled in the operating cycle of the press.

Such an upsetting press, which is provided with a cam drive mechanism for the stamp holder that is mounted on a machine frame, is disclosed, for example, in German Offenlegungsschrift No. 26 53 040. This known upsetting press is a so-called miniature ball press, in other words, an upsetting press for stamping relatively small wire segments into correspondingly small balls having a diameter of only several millimeters. With this known press, as the cam drive mechanism for the stamp holder a simple cam is used that is embodied as a so-called cup wheel. Due to the precision of the press that is required when producing balls having such a small diameter, this heretofore known press is necessarily structurally very complicated. However, due to its fundamental structural design, this press is little, or not at all, suitable for processing considerably larger wire segments into balls, pins, and the like. The forces necessary for processing wire segments that are of an order of magnitude of several millimeters to several centimeters would imply a dimensioning of the press of German Offenlegungsschrift No. 26 53 040 that already for economical reasons would no longer be acceptable.

The upsetting presses that are used to convert wire segments of conventional size into balls, pins, and the like therefore have a presser carriage that is mounted in the machine frame in such a way as to be movable back and forth, and that is driven by a drive motor via a crankshaft and connecting rod. With this proven construction, the conversion during swaging of larger wire segments can in particular be carried out without difficulty. Due to the movement principle of the presser carriage that is inherently prescribed due to the crankshaft drive, and due to the stamp holder with its stamp or matrix that is connected to the presser carriage, and due to the necessity of having enough time available for the movement of the gripper means for the wire segments out of the space between the two matrixes after the movable and fixed matrixes have grasped and held the wire segment, it has been known for a long time to displaceably mount the movable matrix, i.e. the matrix holder therefore, on the presser carriage, thereby enabling an increase of the operating cycle of the press.

With the press that is disclosed in German Offenlegungsschrift No. 27 28 647, and which in principle is also the same type of press, the difficulty resulting from the movement principle of the presser carriage is circumvented to a certain extent by mounting the movable matrix holder, with its matrix, independently from the presser carriage in the machine frame in such a way as to be movable back and forth, and by providing the movable matrix holder with a separate drive mechanism that periodically acts upon the matrix holder independently of the presser carriage. In this way, the movement of the matrix holder, with its matrix, can occur over a certain portion of an operating cycle of the press independently of the course of movement of the presser carriage as prescribed by the crankshaft drive.

However, a drawback of this known press is the fact that for the matrix holder, i.e. the movable matrix, two separate drive mechanisms must be provided that have more or less overlapping movement principles and that result in a correspondingly complicated construction of the press. And yet despite all this, such a press, due to the movement principle of the presser carriage that in the end inherently determines the movement of the pertaining matrix, an optimum movement progress of the matrix holder, with its matrix, is not possible over an entire operating cycle, in contrast to upsetting presses that operate with a cam drive mechanism for the matrix holder.

It is an object of the present invention to improve an upsetting press of the aforementioned general type, which in principle is equipped with a cam drive mechanism, to such an extent that the press is structurally simplified, and that the necessary precision of the movement progress of the stamp holder, with its stamp, is assured even at a relatively high output capacity, i.e. high operating cycle of the upsetting press.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
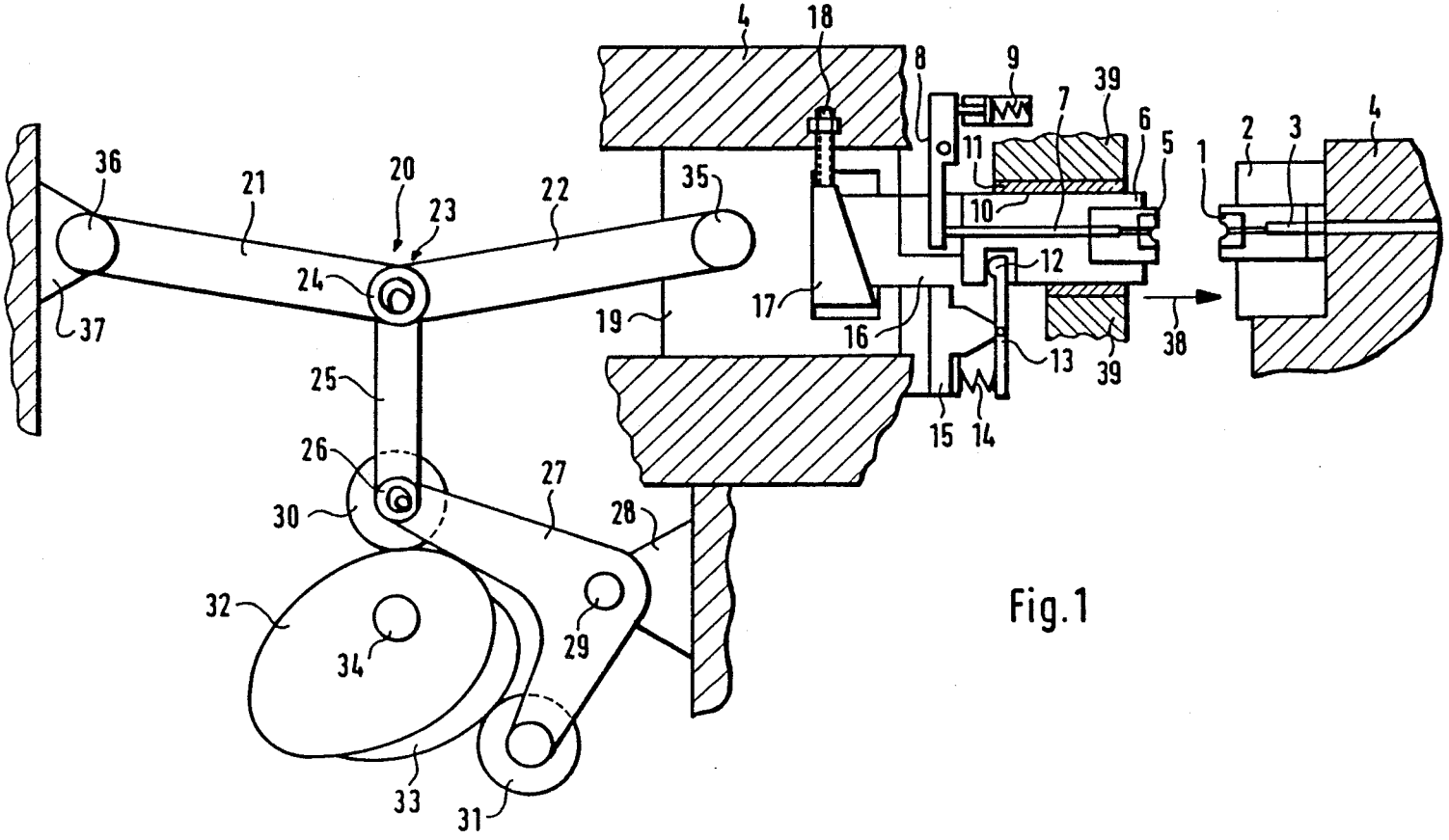
FIG. 1 shows one possible drive approach for the stamp holder, with its stamp, of one exemplary embodiment of the inventive upsetting press, which is otherwise not illustrated in detail.

Starting from a press of the aforementioned general type, the inventive press further comprises: as the cam drive mechanism for the stamp holder, a known double cam that is rotatably mounted in the machine frame; an angle lever that is pivotably mounted in the machine frame; follower rollers that are carried by the angle lever and run on the double cam; a presser carriage that is provided for the stamp holder and is guided in the machine frame in such a way that it can move back and forth; a knee lever having two arms, one of which is connected to the machine frame, and the other of which is connected to the presser carriage; and a connecting rod for operatively interconnecting the angle lever with the knee lever.

Preferably, an approach is used in which the connecting rod is attached to that arm of the knee lever that is connected to the machine frame. However, it is also possible for the connecting rod to be connected to that arm of the knee lever that is connected to the presser carriage. Finally, pursuant to one special specific embodiment of the present invention, the connecting rod can be attached to the knee joint of the knee lever.

In the event that the connecting rod is attached either to that arm of the knee lever that is connected to the machine frame, or to that arm of the knee lever that is attached to the presser carriage, it is furthermore advantageous for the connecting rod to be adjustably secured to the knee lever within the free space or range of a guide that is provided in or on the pertaining arm of the knee lever. This approach offers the possibility for altering or adjusting the stroke of the presser carriage, and hence the possible movement stroke of the stamp holder with its stamp.

This approach is further improved if the guide that is provided in or on the pertaining arm of the knee lever is embodied in the shape of an arc of a circle, with the center point of the circular arc of the guide, when the presser carriage is in the forward end position (stamping position), being disposed in the geometric axis of the point of attachment (joint) of the connecting rod to the angle lever. This makes possible, within the limits of the free space provided by the guide, an adjustment of the connecting rod on the knee lever, and hence an adjustment or alteration of the stroke of the pressure carriage, without thereby altering the front end position (stamping position) of the presser carriage and hence of the stamp holder with its stamp.

As a further advancement of the approach where the connecting rod is attached to the knee joint of the knee lever, the connecting rod can be attached to an eccentric of an adjustable joint pin of the knee lever. In this way, it is then also possible with this approach to have a certain, although slight, adjustment possibility for the stroke of the presser carriage and/or the position of the two end positions of the presser carriage.

Finally, the inventive upsetting press, possibly in combination with one or more of the previous suggestions, can, pursuant to a further embodiment, have the connecting rod secured to the angle lever in such a way that it is adjustable within the free space or range of a guide that is provided in or on the angle lever. This guide could have the shape of an arc of a circle, with the center of the circle of the guide, when the presser carriage is in its forward end position (stamping position), being disposed in the geometrical axis of the point of attached (joint pin) of the connecting rod to the knee lever. The advantages connected with this possible embodiment correspond in principle to those effected with the embodiment of the upsetting press where the connecting rod was adjustably secured within a guide of the knee lever.

In addition to the specific combinations of approaches described, it is to be understood that any other combination of the described approaches would also be possible.

Further specific features of the present invention will be described in detail subsequently.

DESCRIPTION OF THE PREFERRED EMBODIMENTS

Referring now to the drawings in detail, in an upsetting press, which is not shown in further detail, FIG. 1 shows a fixed die or matrix 1 that is secured in a matrix holder 2. The matrix holder 2, in turn, is secured to the machine frame 4 in a manner known per se. In addition, the matrix 1 is provided with a bore, which is not shown in detail, through which an ejector rod 3 operates in a manner known per se.

Shown across from the matrix 1 is a stamp 5 that is mounted and secured in a stamp holder 6. The stamp holder 6 is provided with a ejector rod 7 that is actuated via a lever 8 and a spring 9 in a manner known per se. In the pressing or stamping direction, i.e. in the direction of the arrow 38, the stamp holder 6 is displaceably supported in a sleeve 11 that is provided with guide means 10. The sleeve 11 is secured in a support 39 that is part of the machine frame 4.

Via the end 12 of one arm of a lever 13, the stamp holder 6 is held in engagement against a presser member 16 under the effect of a spring 14. The presser member 16 is mounted on a press carriage 19 and is adjustable via an adjusting key or wedge 17 by means of a set screw 18. The lever 13 is pivotably mounted on a support means 15 that is secured to the presser member 16. The spring 14 is supported on an extension of the support means 15.

Via a joint 35, one arm 22 of a knee lever 20 is attached to the press carriage 19; the other arm 21 of the lever 20 is connected to a fixed support 37 via a joint 36. Provided in the knee joint 23 is a joint pin 24 to which one end of a connecting rod 25 is attached. The other end of the connecting rod 25 is connected with a joint pin 26, which is disposed on an angle lever 27 and at the same time provides support for a follower roller 30. The angle lever 27, which is pivotably mounted about a pin 29 on a fixed support 28, carries at its other end, i.e. at that end that is remote from the follower roller 30, a further follower roller 31. The follower roller 30 runs on a cam 32, and the follower roller 31 runs on a cam 33. The double cam 32, 33, which is formed from the cams 32 and 33, is fixedly connected with a drive shaft 34.

Via appropriate selection of the course or trace of the curve of the cams 32 and 33 of the double cam 32, 33, and appropriate dimensioning and spacial arrangement of the knee lever 20 and the connecting rod 25, practically every desired principle of motion for the stamp holder 6 with its stamp 5 can be achieved. In addition to adequate pressing force and optimum progress of the pressing force during the actual conversion process, first an optimum period of time can be kept available for the movement of the gripper mechanism out of the space between the matrix 1 and the stamp 5; in addition, a relatively high pressing cycle can be achieved at maximum, "soft" transitions between the various drive speeds of the press carriage 19, i.e. the stamp 5.

Figure 2:
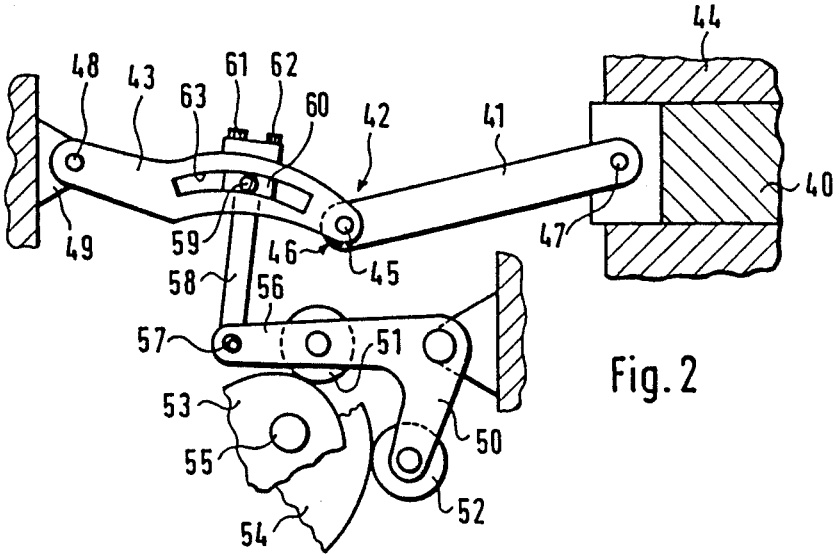
FIG. 2 shows a further drive approach for an inventive upsetting press, with the possibility of adjusting or altering the stroke for the stamp holder and its stamp.

FIG. 2 shows one preferred specific embodiment of an inventive upsetting press. This embodiment differs from that of FIG. 1 essentially in that the connecting rod that is connected to the angle lever of the double cam drive is connected to the knee lever in such a way as to be adjustable within the free space or range of a guide that is provided in that arm of the knee lever that has one end supported on the machine frame. The presser carriage 40, which is illustrated only partially in the embodiment of FIG. 2, is connected to one end of an arm 41 of the knee lever 42, the other arm 43 of which is supported on the machine frame 44. The arms 41 and 43 are pivotably interconnected via a pin 45 that forms the knee joint 46 of the knee lever 42. In addition, the arms 41 and 43 are connected via joints 47 or 48 to the presser carriage 40 and the support 49 disposed on the machine frame 44 respectively.

The angle lever 50 carries follower rollers 51 and 52 that run on cams 53 or 54 which, as a double cam 53, 54, are rotatably driven via a rotating drive shaft 55, as was the case with the embodiment of FIG. 1.

One end of a connecting rod 58 is attached to one arm 56 of the angle lever 50 at a joint 57; the other end of the connecting rod 58 is connected with a joint 59. The joint 59 is mounted in or on a sliding block or the like 60 that, via set screws 61 and 62, is adjustably secured in a guide 63 provided in the arm 43. The guide 63 has the shape of a circular arc, and in particular in such a way that the center of the circle of the guide 63, when the presser carriage 40 has assumed its forward end position (stamping position), is disposed in the geometrical axis of the point of attachment of the connecting rod 58 to the angle lever 50, i.e. in the center of the joint 57. This makes it possible, while maintaining the prescribed forward end position of the presser carriage, to nevertheless be able to alter the stroke of the presser carriage.

Figure 3:
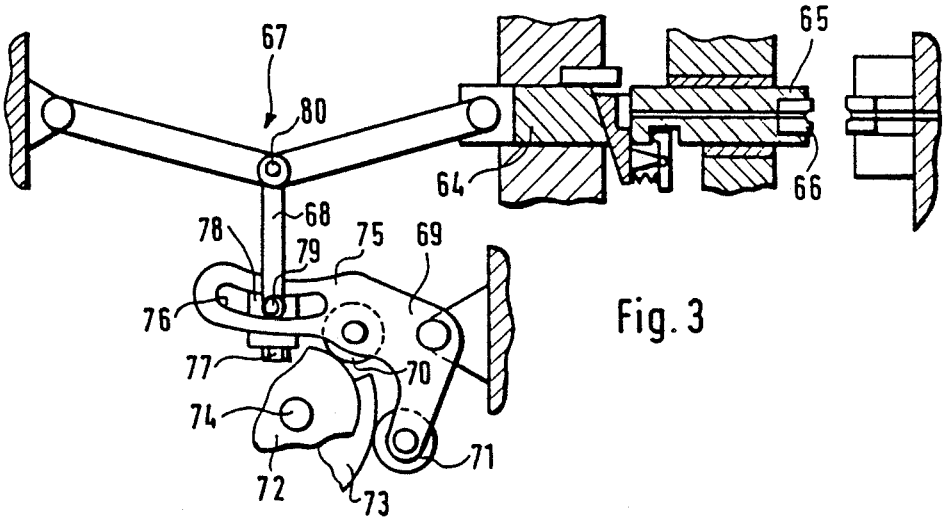
FIG. 3 shows a further, preferred drive approach for an inventive upsetting press, with the possibility of adjusting or altering the stroke for the stamp holder and its stamp.

In a manner similar to the illustrations of FIGS. 1 and 2, the embodiment of FIG. 3 shows merely the region of the drive arrangement for the presser carriage of an inventive upsetting press. In the embodiment of FIG. 3, similar to the embodiments of FIGS. 1 and 2, a presser carriage 64 for a stamp holder 65 having a stamp 66 is drivingly connected via a knee lever 67 and connecting rod 68 with an angle lever 69, which carries follower rollers 70 and 71 for a cam 72 or 73 of a double cam 72, 73. The double cam 72, 73 is fixedly connected with a drive shaft 74.

The drive approach of FIG. 3 differs from those of FIGS. 1 and 2 in that a guide 76 is provided in one arm 75 of the angle lever 69. A sliding block 78, which is adjustable via a set screw 77, is disposed in the guide 76; a joint 79 for one end of the connecting rod 68 is mounted on the sliding block 78. The guide 76 preferably has the shape of an arc of a circle, and is embodied in such a way that the center of the circle of the guide 76, when the presser carriage 64 has assumed the forward end position (stamping position), is disposed in the geometric axis of the point of attachment of the connecting rod 68 to the knee lever 67. In the embodiment illustrated in FIG. 3, the point of attachment of the connecting rod 68 to the knee lever 67 is the joint pin 80.

In place of the possibilities provided by the embodiments of FIGS. 2 and 3 for adjusting the stroke and also the two end positions of the presser carriage, or also as a supplement to the drive approaches illustrated in FIGS. 1 to 3, it is furthermore possible for one or both ends of the connecting rod that is provided between the knee lever and the angle lever to be attached to a cam or eccentric of a joint pin that is additionally adjustably, i.e. rotatably or pivotably, mounted on the knee lever or on the angle lever. This approach then provides additional, although slight, adjustment possibilities for the overall stroke and end positions of the presser carriage.

The present invention is, of course, in no way restricted to the specific disclosure of the specification and drawings, but also encompasses any modifications within the scope of the appended claims.

What I claim is:

1. In an upsetting press for upsetting or swaging wire segments of predetermined lengths into balls or the like, with said press including a fixed matrix, a stamp holder that is provided for a stamp and is mounted on a machine frame in such a way as to be displaceable in the stamping direction, a cam drive mechanism for said stamp holder, and gripper means provided for said wire segments and controlled in the operating cycle of said press, the improvement further comprising:

as said cam drive mechanism for said stamp holder, a double cam that is rotatably mounted in said machine frame;

an angle lever pivotably mounted in said machine frame;

follower rollers that are carried by said angle lever and run on said double cam;

a presser carriage that is provided for said stamp holder and is guided in said machine frame in such a way that it can move back and forth;

a knee lever having two arms, one of which is connected to said machine frame, and the other of which is connected to said pressure carriage;

a connecting rod for operatively interconnecting said angle lever with said knee lever; and one of said arms of said knee lever being provided with a guide means, with said connecting rod being secured to said knee lever in such a way that it is adjustable within a free space of said guide means.

2. An upsetting press according to claim 1, in which said connecting rod is connected to that one arm of said knee lever that is connected to said machine frame.

3. An upsetting press according to claim 1, in which said connecting rod is connected to that other arm of said knee lever that is connected to said presser carriage.

4. An upsetting press according to claim 1, in which said connecting rod is attached to a knee joint of said knee lever.

5. An upsetting press according to claim 1, in which said guide means has the shape of an arc of a circle, with the center of said circular arc, when said presser carriage is in a forward end or stamping position, being disposed in the geometrical axis of a point of attachment of said connecting rod to said angle lever.

6. In an upsetting press for upsetting or swaging wire segments of predetermined lengths into balls or the like, with said press including a fixed matrix, a stamp holder that is provided for a stamp and is mounted on a machine frame in such a way as to be displaceable in the stamping direction, a cam drive mechanism for said stamp holder, and gripper means provided for said wire segments and controlled in the operating cycle of said press, the improvement further comprising:

as said cam drive mechanism for said stamp holder, a double cam that is rotatably mounted in said machine frame;

an angle lever pivotably mounted in said machine frame;

follower rollers that are carried by said angle lever and run on said double cam;

a presser carriage that is provided for said stamp holder and is guided in said machine frame in such a way that it can move back and forth;

a knee lever having two arms, one of which is connected to said machine frame, and the other of which is connected to said pressure carriage;

a connecting rod for operatively interconnecting said angle lever with said knee lever; and said connecting rod being attached to eccentric means of a movable joint pin of at least one said knee lever and said angle lever.

7. In an upsetting press for upsetting or swaging wire segments of predetermined lengths into balls or the like, with said press including a fixed matrix, a stamp holder that is provided for a stamp and is mounted on a machine frame in such a way as to be displaceable in the stamping direction, a cam drive mechanism for said stamp holder, and gripper means provided for said wire segments and controlled in the operating cycle of said press, the improvement further comprising:

as said cam drive mechanism for said stamp holder, a double cam that is rotatably mounted in said machine frame;

an angle lever pivotably mounted in said machine frame;

follower rollers that are carried by said angle lever and run on said double cam;

a presser carriage that is provided for said stamp holder and is guided in said machine frame in such a way that it can move back and forth;

a knee lever having two arms, one of which is connected to said machine frame, and the other of which is connected to said pressure carriage;

a connecting rod for operatively interconnecting said angle lever with said knee lever; and said angle lever being provided with a guide means, with said connecting rod being secured to said angle lever in such a way that it is adjustable within a free space of said guide means.

8. An upsetting press according to claim 7, in which said guide means has the shape of an arc of a circle, with the center of said circular arc, when said presser carriage is in a forward end or stamping position, being disposed in the geometrical axis of a point of attachment of said connecting rod to said knee lever.

* * * * *

UNITED STATES PATENT AND TRADEMARK OFFICE

CERTIFICATE OF CORRECTION

PATENT NO. : 4,967,586

DATED : 6 November 1990

INVENTOR(S) : Jürgen Hecht

It is certified that error appears in the above-identified patent and that said Letters Patent is hereby corrected as shown below:

On the title page, please insert the following:

[30] Foreign Application Priority Data

July 23, 1988 [DE] Fed. Rep. of Germany....3825128

Signed and Sealed this

Fourteenth Day of July, 1992

*Attest:*

DOUGLAS B. COMER

*Attesting Officer*

*Acting Commissioner of Patents and Trademarks*